US010074463B2

(12) United States Patent
Huang

(10) Patent No.: US 10,074,463 B2
(45) Date of Patent: Sep. 11, 2018

(54) METHOD FOR MAKING HIGH-TEMPERATURE WINDING CABLE

(71) Applicant: Vadd Tech Inc., Taipei (TW)

(72) Inventor: King-Chung Huang, Taipei (TW)

(73) Assignee: VADD TECH INC., Taipei (TW)

( * ) Notice: Subject to any disclaimer, the term of this patent is extended or adjusted under 35 U.S.C. 154(b) by 302 days.

(21) Appl. No.: 14/983,572

(22) Filed: Dec. 30, 2015

(65) Prior Publication Data

US 2017/0194079 A1 Jul. 6, 2017

(51) Int. Cl.

| | |
|---|---|
| ***H01B 13/08*** | (2006.01) |
| ***H01B 13/14*** | (2006.01) |
| ***H01B 1/02*** | (2006.01) |
| ***H01B 3/44*** | (2006.01) |
| ***H01B 3/30*** | (2006.01) |
| ***H01B 3/28*** | (2006.01) |
| *H01B 7/06* | (2006.01) |

(52) U.S. Cl.

CPC ..... *H01B 13/148* (2013.01); *H01B 1/02* (2013.01); *H01B 3/28* (2013.01); *H01B 3/302* (2013.01); *H01B 3/445* (2013.01); *H01B 13/141* (2013.01); *H01B 7/065* (2013.01)

(58) Field of Classification Search

CPC ..... H01B 13/148; H01B 13/141; H01B 13/0016; H01B 13/0036; H01B 1/02; H01B 13/08–13/0891; H01B 3/445; H01B 3/302; H01B 3/28; H01B 7/065; Y10T 29/49123

USPC ..... 29/828

See application file for complete search history.

(56) References Cited

U.S. PATENT DOCUMENTS

| | | | | |
|---|---|---|---|---|
| 4,150,480 A * | 4/1979 | Brandt | H01B 9/06 | 156/48 |
| 4,158,104 A * | 6/1979 | Ross | H01B 7/083 | 156/55 |
| 4,861,945 A * | 8/1989 | Buck | H01B 7/065 | 174/106 R |
| 5,763,836 A * | 6/1998 | Anastasi | H01B 7/065 | 174/138 F |
| 8,563,860 B1 * | 10/2013 | Ramos, Jr. | H01B 7/065 | 174/69 |
| 2003/0221786 A1 * | 12/2003 | Tsai | B65H 81/08 | 156/428 |
| 2007/0222686 A1 * | 9/2007 | Carscallen, II | B66F 9/122 | 343/700 R |

(Continued)

*Primary Examiner* — Peter DungBa Vo
*Assistant Examiner* — Kaying Kue
(74) *Attorney, Agent, or Firm* — Leong C. Lei

(57) ABSTRACT

A method for making a high-temperature winding cable is winding a tinned copper line around a coaxial line, signal lines and power lines after being assembled together, lapping the rim of the tinned copper line with a packaging material of Polytetrafluoroethene, and then, extruding an insulating layer of thermoplastic material on the rim of the packaging material, and finally, extruding an outer cover of fluororubber on the outer rim of the insulating layer, thereby forming a cable; sintering the cable; winding the sintered cable clockwise around and fixing it to a iron bar; cooling the wound cable; and finally, taking down the wound cable from the iron bar by rewinding it counterclockwise so as to obtain a high-temperature winding cable. The winding cable so made is not melt, damaged, and retains elasticity after the impact of high temperature 260° C.

7 Claims, 2 Drawing Sheets

(56) References Cited

U.S. PATENT DOCUMENTS

| | | | | |
|---|---|---|---|---|
| 2009/0071686 | A1* | 3/2009 | Boser | A61N 1/05 174/110 R |
| 2009/0183897 | A1* | 7/2009 | Plourde | H01B 11/1847 174/120 R |
| 2010/0212933 | A1* | 8/2010 | Hayashishita | H01B 11/1895 174/113 C |
| 2011/0067220 | A1* | 3/2011 | Campbell | F16G 11/042 29/428 |
| 2015/0093573 | A1* | 4/2015 | Sevier | H01B 3/421 428/375 |
| 2015/0372367 | A1* | 12/2015 | Huang | H01B 7/065 333/241 |
| 2016/0276910 | A1* | 9/2016 | Mizushima | D07B 7/027 |
| 2017/0287591 | A1* | 10/2017 | Zhang | H01B 7/0241 |
| 2017/0287597 | A1* | 10/2017 | Wagner | H01B 11/1895 |

* cited by examiner

METHOD FOR MAKING HIGH-TEMPERATURE WINDING CABLE

TECHNICAL FIELD OF THE INVENTION

The present invention relates to a method for making a high-temperature winding cable, and more particularly to a method for making a winding cable, the cable so made being unable to be melt, not easy to crack and retaining elasticity, and at the same time, still having the normal effects of signal transmission, insulation resistivity and, voltage and current withstanding after the impact of high temperatures.

DESCRIPTION OF THE PRIOR ART

Cables are common elements in electronics industry for signal or power transmission, currently, having been applying widely in information commodities, communication equipment, medical instruments and other related fields.

The outer or inner insulating materials of common conventional cables are usually made from Polyvinylchloride (PVC) or Thermoplastic Polyurethane (TPU). However, they can only resist the temperatures ranged from 60° C. to 105° C., resulting in the easy damage of the cables because the load is to large to yield heat source easily, or the melting of the cable due to destruction of external factors (e.g. fire accident) upon use, not only incapable of blocking combustion, but prone to have the spread of combustion because they are not resistant to high temperatures.

SUMMARY OF THE INVENTION

The main object of the present invention is to provide a method for making a high-temperature winding cable, allowing the cable to be not melt, not easy to crack and retain elasticity, and at the same time, still have the normal effects of signal transmission, insulation resistivity and, voltage and current withstanding after the impact of high temperatures.

To achieve the object mentioned above, the present invention proposes a method for making a high-temperature winding cable, including the following steps:

cable forming: winding a tinned copper line around a coaxial line, a plurality of signal lines and a plurality of power lines after being assembled together, and lapping a rim of the timed copper wire with a packaging material made from Polytetrafluoroethene (PTFE), and then, extruding an insulating layer of thermoplastic material on a rim of the packaging material, and finally, extruding an outer cover of fluororubber on a rim of the insulating layer, thereby forming a cable;

high-temperature sintering: sintering the cable with a temperature ranged from 200° C. to 250° C. for 30 to 45 minutes;

winding cable shaping: winding the sintered cable clockwise on an iron bar, and fixing the wound cable into position;

baking: placing the cable wound on the iron bar in a baker, and baking it with a temperature ranged from 180° C.~200° C. for at least 30 minutes;

cooling: cooling the baked cable wound on the iron bar with water of temperature 45° C. for 10 to 15 minutes;

winding cable forming: a winding cable will be formed on the iron bar after being cooled with water; thereafter, taking down the winding cable from the iron bar by rewinding it counterclockwise, thereby completing the manufacturing of the high-temperature winding cable.

In one embodiment of the present invention, diameters of the coaxial line, each signal line and each power line are respectively ranged from 22 AWG to 32 AWG.

In one embodiment of the present invention, the coaxial line comprises a conductor, inner insulating layer covering the conductor, weaving layer covering inner insulating layer, and outer insulating layer covering weaving layer, the conductor is made of tinned copper, and the inner, outer insulating layers are respectively made from Polyfluoroalkoxy (PFA), Fluorinated ethylene propylene (FEP), or Polytetrafluoroethene (PTFE).

In one embodiment of the present invention, each signal line comprises a conductor and insulating layer covering the conductor, the conductor is made of tinned copper, and the insulating layer is made from Polyfluoroalkoxy (PFA), Fluorinated ethylene propylene (FEP) or Polytetrafluoroethene (PTFE).

In one embodiment of the present invention, each power line comprises a conductor and an insulating layer covering the conductor, the conductor is made of tinned copper, the insulating layer is made from Polyfluoroalkoxy (PFA), Fluorinated ethylene propylene (FEP) or Polytetrafluoroethene (PTFE).

In one embodiment of the present invention, the insulating layer is made from Thermoplastic Polyurethane (TPU), thermoplastic elastomer (TPE) or Ethylene-Propylene-Diene Monomer (EPDM).

In one embodiment of the present invention, an outer diameter of the winding cable is ranged from 4 mm to 6 mm.

DETAILED DESCRIPTION OF THE PREFERRED EMBODIMENTS

Figure 1:
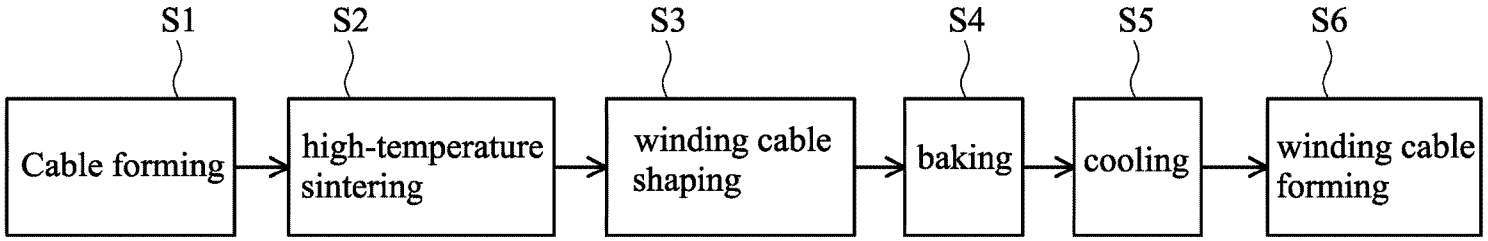
FIG. 1 is a flow chart of a method for making a high-temperature winding cable according to the present invention.
Figure 2:
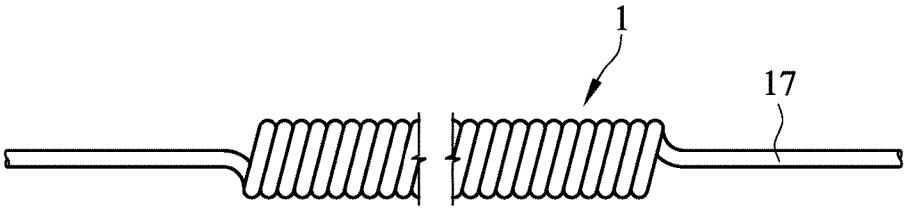
FIG. 2 is a schematic view of a winding cable according to the present invention.
Figure 3:
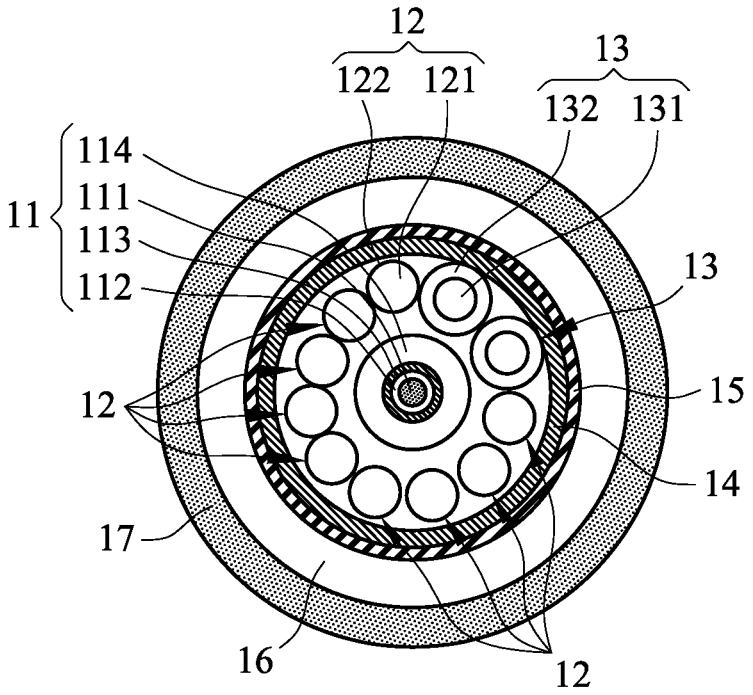
FIG. 3 is a cross-sectional view of the winding cable according to the present invention.

Referring to FIGS. 1 to 3, which respectively are a flow chart of a manufacturing method, a schematic view of a winding cable, and a cross-sectional view of the winding cable according to the present invention, the method for making a high temperature winding cable includes the following steps:

Cable forming S1: winding a tinned copper wire 14 around a coaxial line 11, a plurality of signal lines 12 and a plurality of power lines 13 after being assembled together, lapping the rim of the timed copper wire 11 with a packaging material 15 made from Polytetrafluoroethene (PTFE), and then, extruding an insulating layer 16 of thermoplastic material on the rim of the packaging material 15, and finally, extruding an outer cover 17 of fluororubber on the rim of the insulating layer 16, thereby forming a cable. The diameters of the coaxial line 11, each signal line 12 and each power line 13 are respectively ranged from 22 AWG to 32 AWG where the coaxial line 11 includes a conductor 111, inner insulating layer 112 covering the conductor 111, weaving layer 113 covering the inner insulating layer 112, and outer insulating layer 114 covering the weaving layer 113, where the conductor 111 is made of timed copper, and the inner, outer insulating layers 112, 114 are made from Polyfluoroalkoxy (PFA), Fluorinated ethylene propylene (FEP), or Polytetrafluoroethene (PTFE); each signal line 12 includes a conductor 121 and an insulating layer 122 covering the conductor 121, where the conductor 121 is made of timed copper, and the insulating layer 122 is made from Polyfluoroalkoxy (PFA), Fluorinated ethylene propylene (FEP) or Polytetrafluoroethene (PTFE); each power line 13 includes a conductor 131 and an insulating layer 132 covering the conductor 131, where the conductor 131 is made of tinned copper, and the insulating layer 132 is made from Polyfluoroalkoxy (PFA), Fluorinated ethylene propylene (FEP) or Polytetrafluoroethene (PTFE); the insulating layer 16 is made from Thermoplastic Polyurethane (TPU), thermoplastic elastomer (TPE) or Ethylene-Propylene-Diene Monomer (EPDM);

high-temperature sintering S2: sintering the cable with a temperature ranged from 200° C. to 250° C. for 30 to 45 minutes;

winding cable shaping S3: winding the sintered cable clockwise on an iron bar, and fixing the wound cable into position;

baking S4: placing the cable wound on the iron bar in a baker, and baking it with a temperature ranged from 180° C.~200° C. for at least 30 minutes;

cooling S5: cooling the baked cable wound on the iron bar with water of temperature 45° C. for 10 to 15 minutes;

winding cable forming S6: a winding cable will be formed on the iron bar after being cooled with water. Thereafter, taking down the winding cable form the iron bar by rewinding it counterclockwise, thereby completing the manufacturing of the high-temperature winding cable 1, where the outer diameter of the winding cable 1 is ranged from 4 mm to 6 mm.

The winding cable 1 made according to the steps mentioned above can resist the impact of temperature 260 for 5 minutes without being melt, damaged and still capable of retaining elasticity. In addition, the winding cable 1 after the impact still has the effects of signal transmission, insulation resistivity and, voltage and current withstanding upon use.

I claim:

1. A method for making a high-temperature winding wire, comprising the following steps:

winding a tinned copper line around a coaxial line, a plurality of signal lines and a plurality of power lines after being assembled together, lapping a rim of said timed copper wire with a packaging material made from Polytetrafluoroethene (PTFE), and then, extruding an insulating layer of thermoplastic material on a rim of said packaging material, and finally, extruding an outer cover of fluororubber on a rim of said insulating layer, thereby forming a cable;

high-temperature sintering said cable with a temperature ranged from 200° C. to 250° C. for 30 to 45 minutes to form a sintered cable;

a winding cable is formed by shaping said sintered cable clockwise on an iron bar, and fixing into position;

placing said sintered cable wound and fixed on the iron bar in a baker, and baking said sintered cable with a temperature ranged from 180° C. ~200° C. for at least 30 minutes to form a baked cable;

cooling said baked cable wound on the iron bar with water of temperature 45° C. for 10 to 15 minutes;

said winding cable will be formed on the iron bar after being cooled with water; thereafter, taking down said winding cable from the iron bar by rewinding said winding cable counterclockwise, thereby completing the manufacturing of said high-temperature winding cable.

2. The method according to claim 1, wherein diameters of said coaxial line, each signal line and each power line are respectively ranged from 22 AWG to 32 AWG.

3. The method according to claim 2, wherein said coaxial line comprises a conductor, inner insulating layer covering the conductor, weaving layer covering inner insulating layer, and outer insulating layer covering weaving layer, said conductor is made of tinned copper, and said inner, outer insulating layers are respectively made from Polyfluoroalkoxy (PFA), Fluorinated ethylene propylene (FEP), or Polytetrafluoroethene (PTFE).

4. The method according to claim 3, wherein said each signal line comprises a conductor and insulating layer covering said conductor, said conductor is made of tinned copper, and said insulating layer is made from Polyfluoroalkoxy (PFA), Fluorinated ethylene propylene (FEP) or Polytetrafluoroethene (PTFE).

5. The method according to claim 4, wherein said each power line comprises a conductor and an insulating layer covering said conductor, said conductor is made of a tinned copper material, said insulating layer is made from Polyfluoroalkoxy (PFA), Fluorinated ethylene propylene (FEP) or Polytetrafluoroethene (PTFE).

6. The method according to claim 1, wherein said insulating layer is made from Thermoplastic Polyurethane (TPU), thermoplastic elastomer (TPE) or Ethylene-Propylene-Diene Monomer (EPDM).

7. The method according to claim 1, wherein an outer diameter of said winding cable is ranged from 4 mm to 6 mm.

* * * * *